US008247713B2

(12) United States Patent
Ui et al.

(10) Patent No.: US 8,247,713 B2
(45) Date of Patent: Aug. 21, 2012

(54) SLIDE SWITCH STRUCTURE AND POWER SEAT SWITCH USING THE SAME

(75) Inventors: Shuichi Ui, Kariya (JP); Toshihide Azuma, Kariya (JP); Tomonori Sugiura, Iwakura (JP)

(73) Assignee: Toyota Boshoku Kabushiki Kaisha, Kariya-Shi (JP)

( * ) Notice: Subject to any disclaimer, the term of this patent is extended or adjusted under 35 U.S.C. 154(b) by 281 days.

(21) Appl. No.: 12/722,031

(22) Filed: Mar. 11, 2010

(65) Prior Publication Data

US 2010/0258424 A1 Oct. 14, 2010

(30) Foreign Application Priority Data

Apr. 13, 2009 (JP) ..... 2009-097487

(51) Int. Cl.
*H01H 15/10* (2006.01)

(52) U.S. Cl. ..... 200/5 R; 200/547; 200/548; 200/551

(58) Field of Classification Search ..... 200/5 R, 200/17 R, 18, 547, 548, 551
See application file for complete search history.

(56) References Cited

U.S. PATENT DOCUMENTS

| | | | | |
|---|---|---|---|---|
| 3,843,852 | A * | 10/1974 | Lockard | 200/16 D |
| 4,241,244 | A * | 12/1980 | Swann | 200/6 R |
| 4,324,598 | A * | 4/1982 | Kimoto et al. | 148/111 |
| 5,111,011 | A * | 5/1992 | Roswold | 200/550 |
| 5,844,182 | A * | 12/1998 | Hirano et al. | 200/5 R |
| 5,901,839 | A * | 5/1999 | Sasaki et al. | 200/551 |
| 6,262,379 | B1 * | 7/2001 | Tajima | 200/5 R |
| 6,515,241 | B2 * | 2/2003 | Saiki | 200/5 R |
| 6,686,550 | B2 | 2/2004 | Seki et al. | |
| 6,759,606 | B2 * | 7/2004 | Fortuny Riera | 200/5 R |
| 6,998,546 | B1 * | 2/2006 | Schmidt et al. | 200/5 R |
| 7,078,641 | B2 * | 7/2006 | Stack et al. | 200/553 |

FOREIGN PATENT DOCUMENTS

| | | |
|---|---|---|
| JP | 09-161603 | 6/1997 |
| JP | 2003-77370 | 3/2003 |
| JP | 2008-97935 | 4/2008 |

* cited by examiner

*Primary Examiner* — Michael Friedhofer
(74) *Attorney, Agent, or Firm* — Greenblum & Bernstein, P.L.C.

(57) ABSTRACT

A power seat switch includes a structure main body; switches provided in the structure main body; sliders slidably provided in the structure main body and changing over contacts of the switches; and moderation units each including a moderation adjuster fitted into the structure main body and an elastic portion provided on the slider. Each slider includes a shaft and a pair of legs provided on one end of the shaft. The elastic portion is provided to elastically protrude from the one end of the shaft in an axial direction of the shaft. The moderation adjuster includes a moderation groove arranged to be sandwiched between the legs, in contact with the elastic portion, and applying a moderation according to sliding of the slider.

6 Claims, 6 Drawing Sheets

SLIDE SWITCH STRUCTURE AND POWER SEAT SWITCH USING THE SAME

CROSS-REFERENCE TO RELATED APPLICATIONS

The present application claims priority under 35 U.S.C. §119 of Japanese Application No. 2009-97487 filed on Apr. 13, 2009, the disclosure of which is expressly incorporated by reference herein in its entirety.

BACKGROUND OF THE INVENTION

1. Field of the Invention

The present invention relates to a slide switch structure. More specifically, the present invention relates to a slide switch structure capable of changing senses of operation such as a moderation of a switch without changing other elements, and to a power seat switch using the slide switch structure. The slide switch structure according to the present invention is applicable to such a slide switch using a knob as a power seat switch of a vehicle or a light switch.

2. Description of the Related Art

A slide switch used as a power seat switch of a vehicle or the like includes a moderation unit for obtaining a moderation that is a sense when a user operates the switch to change contacts, as disclosed in Related Arts 1 and 2. The moderation unit of this type obtains the moderation by conveying, to a knob, a stimulus from a motion of a ball provided in a slider of the switch along a moderation groove provided in a movable contact or the like and falling of the ball in a valley of the moderation groove.

This moderation adjustment mechanism is incorporated in a general-purpose switch module incorporated in a slide switch structure. Alternatively, as disclosed in Related Arts 1 and 2, the moderation adjustment mechanism is incorporated in a slide switch structure configured to include contacts or the like. Further, as disclosed in Related Art 3, a moderation groove is often provided in a case.

[Related Art 1] Japanese Patent Laid-open Publication No. 2003-77370

[Related Art 2] Japanese Patent Laid-open Publication No. 2008-97935

[Related Art 3] Japanese Patent Laid-open Publication No. 9-161603

A slide switch structure used as a power seat switch of a vehicle sometimes requires different moderations or the like according to arrangement targets.

However, the slide switch structure using a switch module has a fixed moderation according to a type of the switch module. Due to this, it is necessary to select switch modules including different moderations, respectively. Furthermore, the slide switch structure does not always include moderations necessary for the respective switch modules.

Moreover, as disclosed in the Related Arts 1, 2, 3, or the like, even if the slide switch includes a characteristic moderation unit, it is necessary to give heed so that functions of a movable contact and the like can be maintained when the moderation is changed. This is because the moderation groove is formed integrally with the movable contact, the case or the like. Due to this, the moderation cannot be easily changed.

Furthermore, the senses of operation such a degree of oscillation and a sliding amount of the slider are often adjusted along with the moderation unit. However, to adjust the senses of operation and the moderation unit, it is disadvantageously necessary to adjust various elements provided in the case and the like. The adjustment mechanism, therefore, has an influence on design of many elements.

SUMMARY OF THE INVENTION

Embodiments of the present invention have been made in view of the above-stated situations. It is an object of the embodiments of the present invention to provide a slide switch structure that allows designing of senses of operation such as moderations with a high degree of freedom irrespectively of other elements, and a power seat switch using the slide switch structure.

According to one embodiment of the present invention, there is provided a slide switch structure including: a structure main body; a switch provided in the structure main body; a slider provided slidably in the structure main body, and changing contacts of the switch; and a moderation unit including a moderation adjuster fitted into the structure main body, and an elastic portion provided on the slider, wherein the slider includes a shaft and a pair of legs provided on one end of the shaft, the elastic portion is provided to elastically protrude from the one end-side of the shaft in an axial direction of the shaft, and the moderation adjuster is arranged to be sandwiched between the legs, and includes a moderation groove in contact with the elastic portion and applying a moderation according to sliding of the slider.

Furthermore, in the slide switch structure, the slider causes the moderation adjuster to be sandwiched between the legs and slides along the moderation adjuster.

In the slide switch structure, the switch is a module switch including a module case, a module shaft slidably provided in the module case, and module contacts changed over by the module shaft; and a fitted portion fitted into a tip end of the module shaft is formed on side surfaces of the legs.

In the slide switch structure, protrusions restricting sliding of the slider are formed on both ends of the fitted portion of the moderation adjuster, respectively.

According to another embodiment of the present invention, there is provided a power seat switch including the slide switch structure according to the preceding embodiment of the present invention, wherein the power seat switch includes a plurality of sets of the switches, sliders, and moderation units.

In the power seat switch, the moderation adjusters of the moderation units are identical in a shape of a region fitted into the structure main body.

In the slide switch structure according to embodiments of the present invention, the moderation adjuster fitted into the structure main body is appropriately changed to a moderation adjuster including a moderation groove of another shape, thereby making it possible to adjust the moderation. That is, the moderation adjuster does not include other functions such as contacts related to an electrical circuit and a case accommodating therein other elements but includes only the function related to senses of operation such as the moderation. This can facilitate designing for the purpose of adjusting only the moderation without restricting the design of these other functions.

Furthermore, the moderation adjuster is arranged to be sandwiched between the legs of the slider. It is thereby possible to adjust a degree of oscillation of the slider related to a thickness direction of the moderation adjuster, which degree is one of the senses of operation, according to a distance between the legs and a thickness of the moderation adjuster.

Moreover, if the slider causes the moderation adjuster to be sandwiched between the legs of the slider and slides along the moderation adjuster, it is possible to reduce oscillation of the slider as compared with an instance in which the moderation adjuster is not sandwiched between the legs, and to adjust the oscillation of the slider, which is one of the senses of operation, in a sandwich direction by adjusting a force of sandwiching. It is thereby possible to adjust the moderation and oscillation that are often simultaneously adjusted using one moderation adjuster.

Further, if the module switch is used as the switch and the fitted portion is formed on the legs, it is possible to keep constant accuracy of the contacts and the like resulting from use of the switch module and to ensure that the fitted portion moves the switch shaft of the switch module to change the contacts.

Moreover, if the protrusions are formed on the fitted portion of the moderation adjuster, the moderation adjuster can adjust a sliding amount of the slider. It is thereby possible to adjust the moderation, the oscillation, and the sliding amount, which are the senses of operation often adjusted simultaneously, using one moderation adjuster.

The power seat switch according to an embodiment of the present invention includes the slide switch structure and each moderation adjuster can adjust the senses of operation of each slider. This can facilitate producing a plurality of power seat switches having different senses of operation.

Furthermore, if the moderation adjusters of the moderation units are identical in the shape of the region fitted into the structure main body, it is possible to use moderation adjusters of the same type in portions for which the same senses of operation are required. This can minimize the number of moderation adjusters according to the senses of operation.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

A slide switch structure and a power seat switch using the slide switch structure according to an embodiment of the present invention will be described hereinafter in detail with reference to FIGS. 1 to 11. The slide switch structure according to the embodiment of the present invention can be used in an arbitrary vehicle electric component such as a power seat switch or a light switch, and is also applicable to other purposes without being limited to the vehicle electric component.

The "structure main body" is a combination of a case, a housing, a board and the like for arranging switches, moderation adjusters, sliders 4 and the like.

The "switch" suffices to be a switch capable of changing over contacts of the switch by sliding of each slider to be described later. As the switch, an existing slide switch module or a unique unit combined with a fixed contact, a movable contact and the like can be used.

Figure 3:
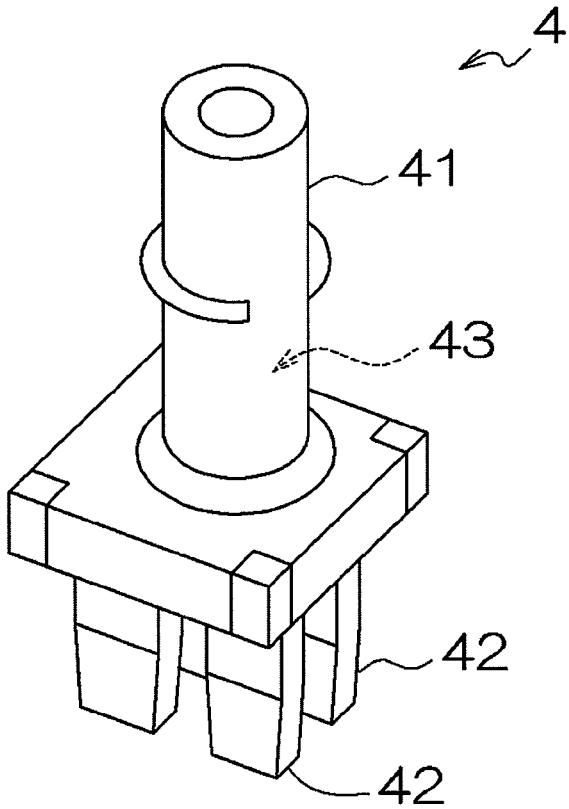
FIG. 3 is a perspective view for describing a slider.
Figure 4:
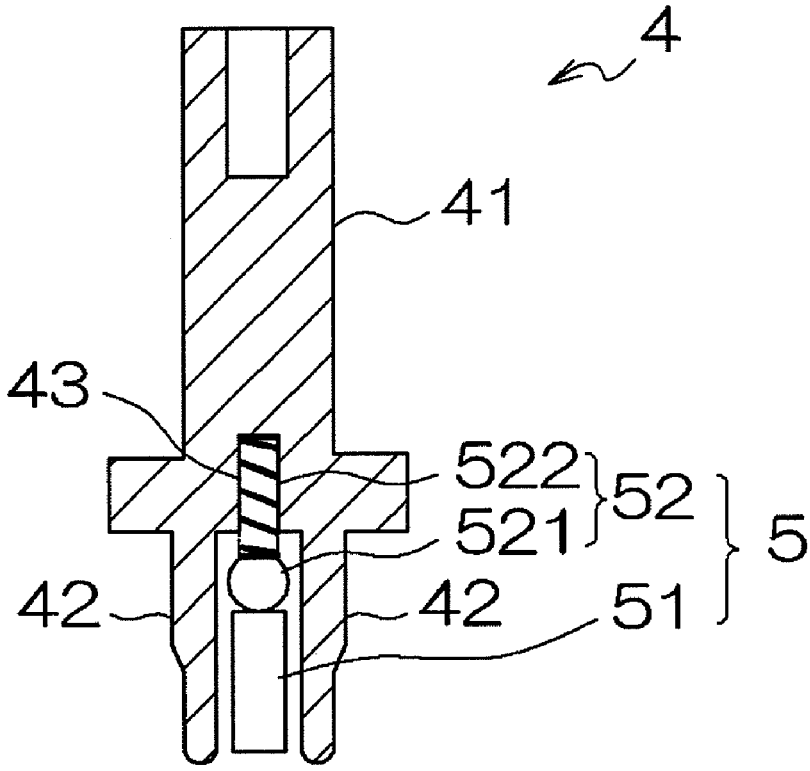
FIG. 4 is a cross-sectional view for describing the slider and an elastic portion.

As exemplarily shown in FIGS. 3 and 4, the "slider" includes a shaft 41 and a pair of legs 42 provided on one end of the shaft 41. An elastic portion 52, to be described later, is provided on the one end of the shaft.

A distance between the paired legs is set to be equal to or larger than a thickness of each moderation adjuster. As shown in FIG. 4, the legs 42 are arranged so as to sandwich the moderation adjuster 51 therebetween. At the time of arrangement, each or one of the distance between the legs 42 and the thickness of the moderation adjuster 51 is adjusted and gaps between the legs 42 and the moderation adjuster 51 are adjusted, whereby a degree of oscillation of the slider in a thickness direction of the moderation adjuster, which degree is a type of the sense of operation, can be adjusted. The reason for need to make such adjustments is as follows. If the oscillation of the slider is too small, an allowance related to operation is eliminated, which makes user's operation difficult and causes operation error. If the oscillation is too large, the operation is made unstable. Furthermore, an optimum range of adjustment differs among targets.

Figure 9:
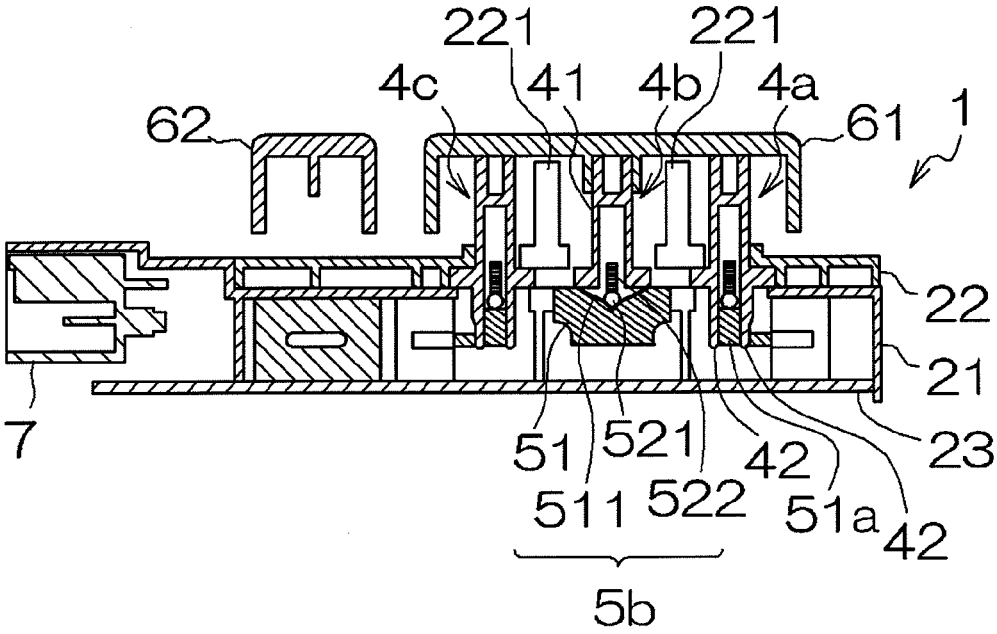
FIG. 9 is a cross-sectional view taken from front for describing the state where the switches, the sliders, and the moderation adjusters are arranged.

As indicated by a slider 4*a* and a moderation adjuster 51*a* shown in FIG. 9, the gaps between the legs 42 and the moderation adjuster 51*a* can be eliminated and the moderation adjuster 51*a* can be sandwiched between the paired legs 42. By doing so, it is possible to reduce the oscillation of the slider 4*a* as compared with an instance in which the moderation adjuster 51*a* is not sandwiched. In addition, by adjusting elasticity of the legs 42 between which the moderation adjuster 51*a* is sandwiched, it is possible to adjust the oscillation of the slider 4*a* in a sandwich direction.

Figure 8:
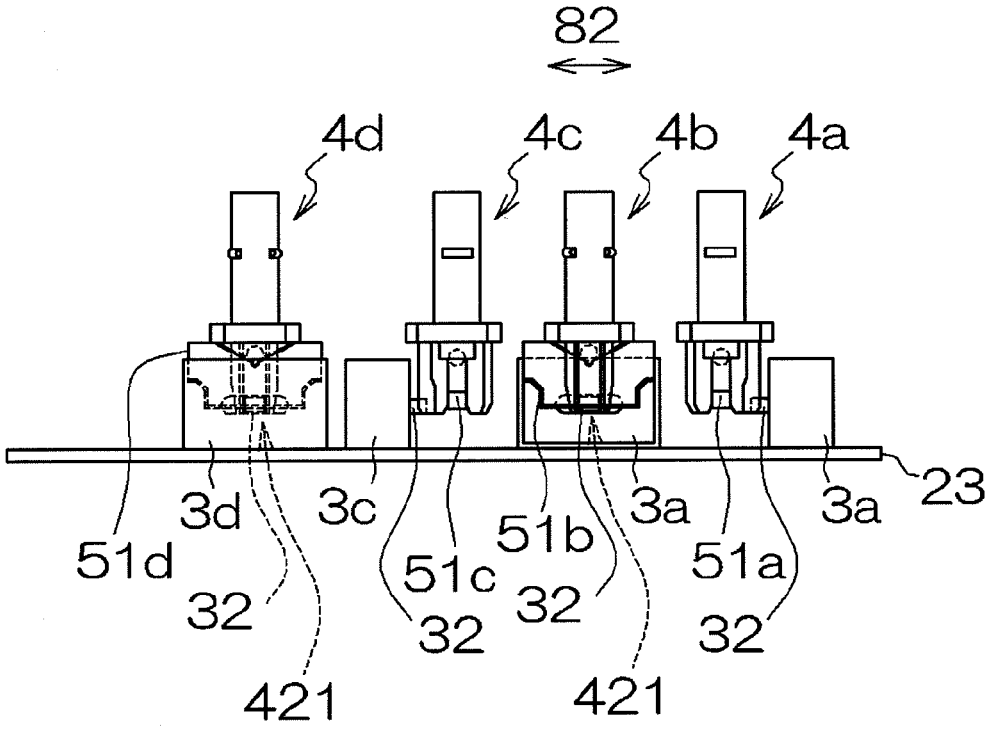
FIG. 8 is a front view for describing a state where switches, the sliders, and the moderation adjusters are arranged.

As exemplarily shown in FIGS. 3 and 8, a fitted portion 421 fitted into a tip end of a module shaft 32, to be described later, can be provided on side surfaces of the legs 42, that is, surfaces of the legs 42 parallel to a slide direction of each of the sliders 4*a* to 4*d*. Such a fitted portion 421 moves as each of the sliders 4*a* to 4*d* slides. Due to this, a contact of each of the switches 3*a* to 3*d* can be changed by moving the module shaft 32 in the slide direction. A shape of the fitted portion is not limited to a specific one but may be formed into, for example, a sandwich structure or a hole into which the module shaft 32 can be inserted as shown in FIG. 3.

The "moderation unit" includes the moderation adjuster fitted into the structure main body and the elastic portion provided on the slider, and functions to obtain a moderation according to the sliding of the slider.

The "elastic portion" is provided to elastically protrude from one end of the shaft in an axial direction of the shaft. The elastic portion suffices to have elasticity so as to always contact with a moderation groove of the moderation adjuster when the slider slides. For example, as the elastic portion, a member such as a ball pressed into the moderation groove, a spring, or the like can be used.

The "moderation adjuster" includes the moderation groove, which groove is fitted into the structure main body so that the moderation adjuster is located between the legs of the slider. An arrangement method of the moderation adjuster is not limited to fitting of the moderation adjuster into the structure main body. The moderation adjuster can be arbitrarily provided by, for example, being fixedly screwed or driven into the structure main body.

The "moderation groove" is a groove for applying a moderation by vertically moving the elastic portion according to irregularities of the groove. Further, the moderation adjuster can include protrusions that prevent excessive sliding of the slider by abutting on the legs of the slider.

A specific example of the slide switch structure configured as stated above will be described with reference to FIGS. 1 to 11.

Figure 1:
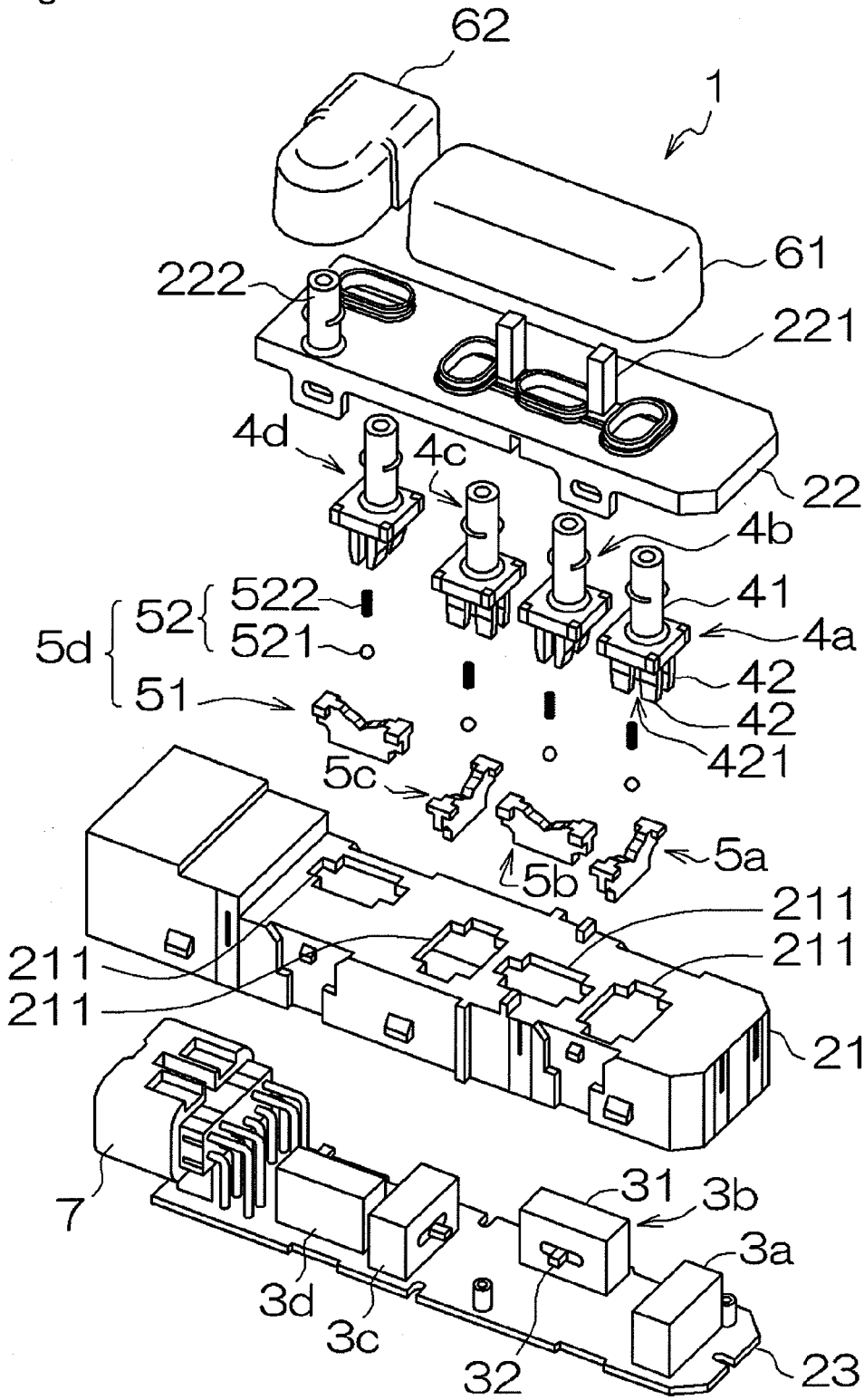
FIG. 1 is a perspective view for describing a configuration of a slide switch structure for a power seat switch and positional relationship among constituent elements of the slide switch according to an embodiment of the present invention.
Figure 2:
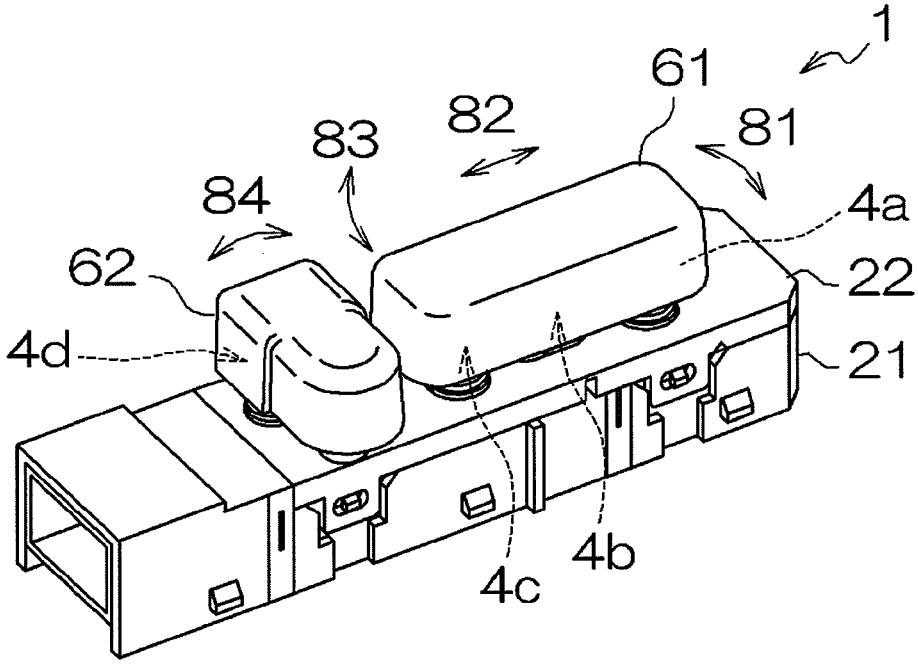
FIG. 2 is a perspective view for describing the configuration of the slide switch structure for the power seat switch and motions of respective knobs according to the embodiment of the present invention.

The slide switch structure 1 is a power seat switch for electrically operating a vehicle seat. As shown in FIGS. 1 and 2, the slide switch structure 1 includes a structure main body configured to include the case main body 21, the upper surface case 22, and the board 23; switches 3*a* to 3*d* provided on the board 23; sliders 4*a* to 4*d*; moderation units 5*a* to 5*d*; a slide knob 61 and a reclining knob 62; a connector 7 provided on the board 23 and connected to contacts of the switches 3*a* to 3*d*. As shown in FIGS. 1 and 8, the slide switch structure 1 includes the switch units 3*a* to 3*d*, the sliders 4*a* to 4*d*, and the moderation units 5*a* to 5*d* as four sets. One slide knob 61 is attached to the sliders 4 of three sets, and the reclining knob 62 is attached to the slider 4 of the remaining one set.

Figure 7:
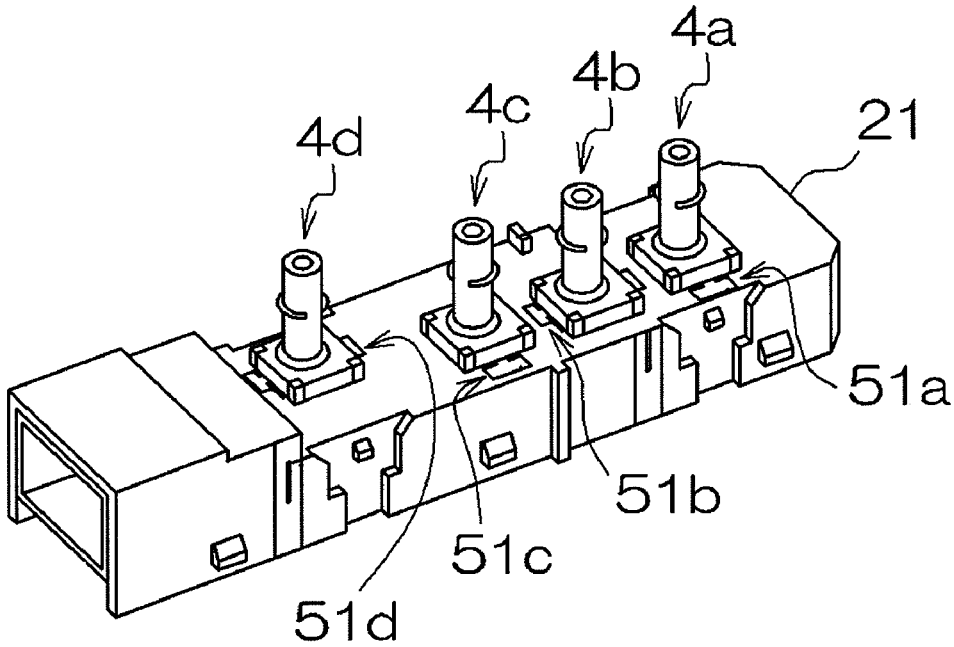
FIG. 7 is a perspective view for describing a state where the moderation adjusters are fitted into the case main body and sliders are provided.

The case main body 21 and the upper surface case 22 are made of resin. As shown in FIGS. 7 and 9, the case main body 21 accommodates therein the board 23, the legs 42 of the sliders 4*a* to 4*d*, the moderation units 5*a* to 5*d*, the connector 7 and the like. The upper surface case 22 is fixedly fitted into the case main body 21 so as to cover up an upper surface of the case main body 21, and has holes into which shafts 41 of the sliders 4*a* to 4*d* are inserted, respectively, and shafts 221 and 222 guiding motions of the knobs 61 and 62, respectively. The board 23 has the switches 3*a* to 3*d* and the connector 7 provided thereon, and electrically connects them.

Each of the switches 3*a* to 3*d* is an existing switch module, and includes a module case 31, fixed and movable contacts (not shown) provided in the module case 31, and a module shaft 32 for moving the movable contact. While a slide switch is exemplarily shown as the switch module, the switch module is not limited thereto but may be a switch having another contact structure.

As shown in FIGS. 1, 3, and 4, each of the sliders 4*a* to 4*d* includes the shaft 41 and the paired legs 42 provided on a bottom, that is, on one end of the shaft 41 and inserted into each attachment hole 211 provided in an upper portion of the case main body 21.

The knob 61 or 62 is provided on a head of the shaft 41, and the shaft 41 conveys the motion of the knob 61 or 62 to the legs 42. The legs 42 have the moderation adjuster 51, to be described later, sandwiched therebetween and function as a guide of a direction in which each of the sliders slides. The fitted portion 421 fitted into a head of the module shaft 32 for moving the module shaft 32 according to sliding of the slider 4 is formed on side surfaces of the legs 42. As shown in FIG. 4, a bottomed hole 43 that is a bottom on one end of the shaft 41 is formed at a position on an axis of the shaft 41. The spring 522 of the elastic portion 52 to be described later is provided around the bottomed hole 43.

Figure 5:
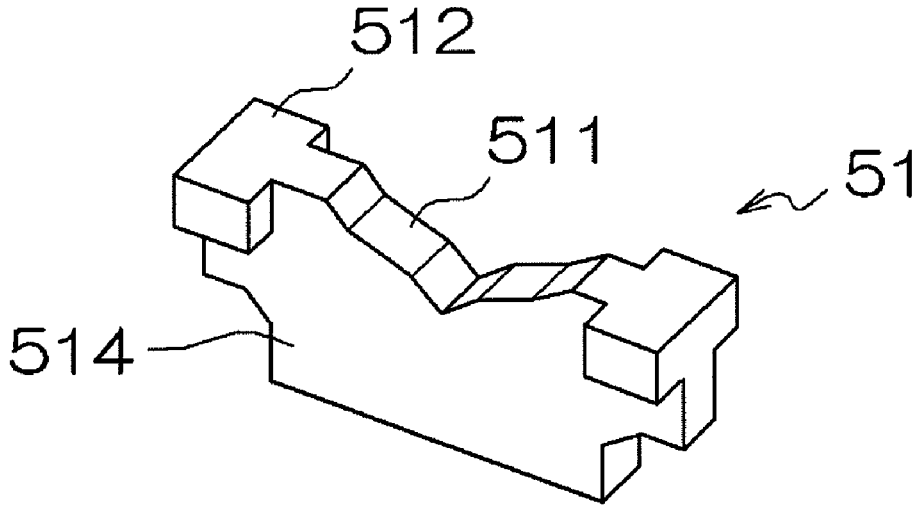
FIG. 5 is a perspective view for describing a moderation adjuster.
Figure 6:
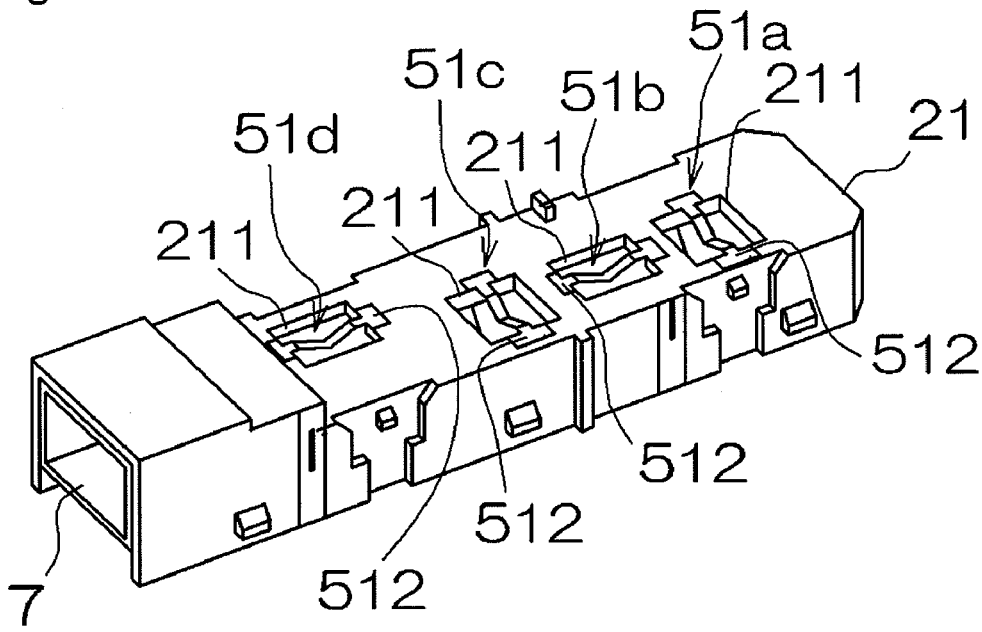
FIG. 6 is a perspective view for describing a state where moderation adjusters are fitted into a case main body.

The moderation units 5*a* to 5*d* include: the moderation adjusters 51 fitted into the attachment holes 211 of the case main body 21 and identical in shape as shown in FIGS. 5 and 6; and the elastic portions 52 provided on bottoms that are one-end sides of the shafts 41 as shown in FIG. 4, respectively.

As shown in FIG. 5, the moderation adjuster 51 is a generally flat adjuster made of resin and includes the moderation groove 511 that is formed on a roof side of the moderation adjuster 51 and has an irregular surface; the protrusions 512 formed to protrude from both ends of the moderation groove 511, respectively; and flat slide surfaces 514 that are a front surface and a rear surface of the moderation adjuster 51, respectively.

Figure 10:
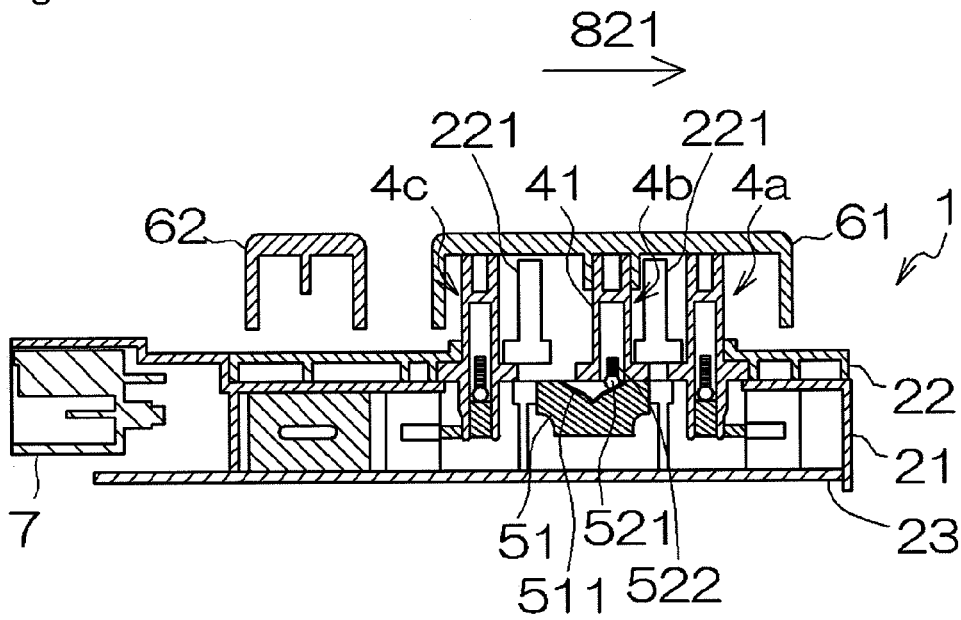
FIG. 10 is a cross-sectional view taken from the front for describing the state where the switches, the sliders, and the moderation adjusters are arranged and a state where a slide knob is slid in a right direction in a drawing sheet.
Figure 11:
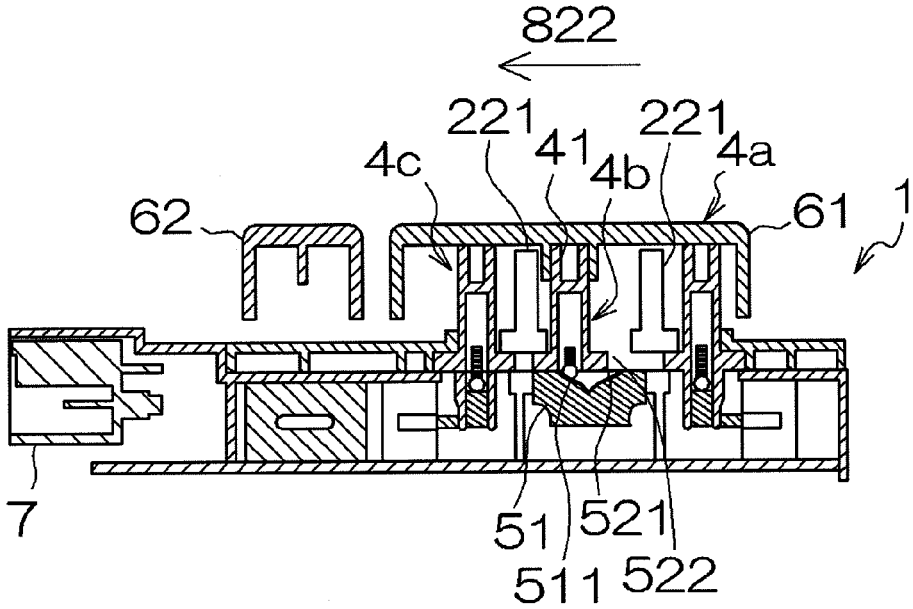
FIG. 11 is a cross-sectional view taken from the front for describing the state where the switches, the sliders, and the moderation adjusters are arranged and a state where the slide knob is slid in a left direction in the drawing sheet.

As shown in FIGS. 9 to 11, the moderation groove 511 can apply a moderation by sliding of the elastic portion 52 on an irregular surface of the moderation groove 511. As shown in FIGS. 5 and 9, the moderation groove 511 has a deepest valley in a central portion thereof, and the spring 522 of the elastic portion 52 guides the slider 4 to always move to the central portion of the moderation groove 511 using an elastic force of the spring 522. As shown in FIGS. 8, 10, and 11, each protrusion 512 has a size suitable for the sliding leg 42 to abut on and stop on the protrusion 512, and prevents the slider 4 from excessively sliding, for example, prevents the slider 4 from moving to surpass the protrusion 512. Further, as shown in FIG. 6, the protrusions 512 are fitted into the attachment hole 211, thereby making it possible to fix the moderation adjuster 51 to the case main body 21.

As shown in FIGS. 7 and 9, the moderation adjusters 51 or 51*a* to 51*d* are located between the legs 42 of the sliders 4 and sandwiched between the legs 42 so that the legs 42 contact with the slide surfaces 514, respectively. Due to this, as shown in FIGS. 9 to 11, each slider 4 can slide in a longitudinal direction of the moderation groove 511 (see an arrow 821 shown in FIG. 10 and an arrow 822 shown in FIG. 11).

As shown in FIGS. 1 and 4, the elastic portion 52 includes the ball 521 in contact with the moderation groove 511, and the spring 522 having one end inserted into the bottomed hole 43 of the shaft 41 and the other end pressing the ball 521 against the moderation groove 511.

The connector 7 has terminals connected to contacts of the respective switches 3*a* to 3*d* and is connected to an ECU or the like by a wire harness or the like.

If a user turns a slider 4*a* side (right side in FIG. 2) of the slide knob 61 of the slide switch structure that is the power seat switch as described above to a direction of an arrow 81, then the slider 4*a* slides, the contact of the switch 3*a* is changed, and the user can adjust a height of a front side of a seat surface.

If the user moves the slide knob 61 in a longitudinal direction thereof, that is, a direction of an arrow 82 shown in FIG. 2, then the slider 4*b* slides, the contact of the switch 3*b* is changed, and the user can move the entire seat forward or backward.

If the user turns a slider 4*c* side (left side in FIG. 2) of the slide knob 61 to a direction of an arrow 83, then the slider 4*c* slides, the contact of the switch 3*c* is changed, and the user can change a height of the entire seating face.

If the user turns the reclining knob 62 to the left or right in FIG. 2, that is, to a direction of an arrow 84, then the slider 4*d* slides, the contact of the switch 3*d* is changed, and the user can adjust an angle of a seat backrest.

More specifically, as shown in FIGS. 8 to 11, if the user operates the slide knob 61 such as user's moving the slider 4*b* in the direction of the arrow 82, then the slider 4*b* slides in a longitudinal direction of the moderation groove 511 of the corresponding moderation adjuster 51, the fitted portion 421 of the legs 42 moves the module shaft 32, and the contact of the switch 3*b* is changed. Further, the ball 521 of the elastic portion 52 moves vertically along irregularities of the moderation groove 511, and a stimulus generated when the ball 521 falls in the valley of the moderation groove 511 is conveyed to the knob 61, thereby making it possible to obtain a moderation.

Moreover, since the moderation adjuster 51 is sandwiched between the legs 42 of the slider 4, the degree of oscillation of the shaft 41 in the thickness direction can be kept constant. The legs 42 abut on the protrusions 512, thereby restricting movement of the slider 4.

Even if the knob 61 or 62 moves the slider 4*a*, 4*c* or 4*d*, the user can obtain senses of operation such as the moderation and the oscillation similarly to the slider 4*b*.

As stated above, the power seat switch 1 according to the embodiment of the present invention can collectively set the three senses of operation, that is, the moderation, the oscillation of the slider, and the sliding amount of the slider by use of the moderation adjuster 51. Furthermore, since the moderation adjuster 51 is fixedly fitted into the case main body 21, the senses of operation can be changed by changing only the moderation adjuster 51 to a moderation adjuster for different senses of operation without affecting designing of other constituent elements such as the switches 3*a* to 3*d* and the sliders 4*a* to 4*d*.

Moreover, by using the existing switch module as each switch 3, it is possible to keep quality of the contacts of the switch 3 constant.

The present invention is not limited to the embodiment stated so far but can be variously changed within a scope of the invention according to purposes and usages. That is, the slide switch structure according to the present invention is not limited to the power seat switch but can be used for electric components such as a light switch. Furthermore, the switches 3, the sliders 4 or the moderation units 5 are described as being identical in shape, respectively, but they may be formed into different shapes. Particularly by setting the moderation grooves 511 of the moderation adjusters 51 of the moderation units 5 to have different irregularities, it is possible to obtain different moderations according to the respective operations. Moreover, by changing thicknesses of the moderation adjusters 51, it is possible to obtain different degrees of oscillation according to the respective operations. Besides, by changing positions of the protrusions 512 of the moderation adjusters 51, it is possible to obtain the sliding amount suited for each operation.

What is claimed is:

1. A slide switch structure, comprising:

a structure main body;

a switch provided in the structure main body;

a slider provided slidably in the structure main body, and changing contacts of the switch; and a moderator including a moderation adjuster fitted into the structure main body, and an elastic portion provided on the slider, wherein the slider includes a shaft and a pair of legs provided on one end of the shaft, the elastic portion is provided to elastically protrude from the one end of the shaft in an axial direction of the shaft, wherein the moderation adjuster is arranged to be sandwiched between the pair of legs, and includes a moderation groove in contact with the elastic portion and applying a moderation according to sliding of the slider, wherein the slider causes the moderation adjuster to be sandwiched between the pair of legs and slides along the moderation adjuster, and wherein the switch is a module switch including a module case, a module shaft slidably provided in the module case, and module contacts changed over by the module shaft, and a fitted portion fitted into a tip end of the module shaft is formed on side surfaces of the pair of legs.

2. The slide switch structure according to claim 1, wherein protrusions restricting sliding of the slider are formed on both ends of the fitted portion of the moderation adjuster, respectively.

3. A power seat switch, comprising:

the slide switch structure according to claim 2, wherein the power seat switch includes a plurality of sets of switches, sliders, and moderators.

4. The power seat switch according to claim 3, wherein moderation adjusters of the moderators are identical in a shape of a region fitted into the structure main body.

5. A power seat switch, comprising:

the slide switch structure according to claim 1, wherein the power seat switch includes a plurality of sets of switches, sliders, and moderators.

6. The power seat switch according to claim 5, wherein moderation adjusters of the moderators are identical in a shape of a region fitted into the structure main body.

* * * * *